United States Patent [19]

Butterfield

[11] 4,418,827

[45] Dec. 6, 1983

[54] TAMPER-ALERTING DEVICE FOR VIALS AND SYRINGES

[75] Inventor: Ida M. Butterfield, Santa Maria, Calif.

[73] Assignee: Butterfield Group, Santa Maria, Calif.

[21] Appl. No.: 363,906

[22] Filed: Mar. 31, 1982

[51] Int. Cl.[3] ..... B65D 41/20

[52] U.S. Cl. ..... 215/247; 604/111

[58] Field of Search ..... 215/247, 248, 249, 366; 604/111, 110, 91, 89

[56] References Cited

U.S. PATENT DOCUMENTS 2,380,556 7/1945 Smith ..... 604/91

4,261,474 4/1981 Cohen ..... 215/247

*Primary Examiner*—Donald F. Norton

*Attorney, Agent, or Firm*—Daniel C. McKown

[57] ABSTRACT

A visually conspicuous object shaped like a disc or plug is mounted at the mouth of a container or in the neck of the container where it is held only by friction or some other easily-overcome force. The object is impenetrable by a hypodermic needle. When such a needle is thrust through the diaphragm-like seal of the container, the needle strikes the object, and overcomes the friction by which the object was retained in the mouth of the container, thereby releasing the object which then falls or migrates into the body of the container to serve as a visual indicator that the seal has been punctured.

7 Claims, 10 Drawing Figures

TAMPER-ALERTING DEVICE FOR VIALS AND SYRINGES

BACKGROUND OF THE INVENTION

1. Field of the Invention

The present invention is in the field of medical devices and more specifically relates to a device that provides a visual indication of whether vials and syringes have been tampered with.

2. The Prior Art

FIG. 1 is an enlarged cross-sectional view through the mouth and neck of a multiple dose vial. Such vials are commonly used to contain injectable mediciments, including narcotics. As shown in FIG. 1, the multiple dose vial includes a glass container 2 whose mouth is sealed by a rubber seal 4 which is pressed against the mouth of the container 2 and held in place by a metal closure 6 that is swaged around the lip 8 of the glass container 2.

In use, fluid is removed from the multiple dose vial of FIG. 1 by inserting the needle of a hypodermic syringe through an aperture 10 in the metal closure 6, through the rubber seal 4 and into the fluid. The fluid is then aspirated into the hypodermic syringe.

FIG. 2 is an enlarged cross-sectional view of the end of a hypodermic syringe cartridge to which the needle is attached. Although the diameter of the cartridge shown in FIG. 2 is somewhat smaller than that of the multiple dose vial of FIG. 1, the structure is quite similar. The cartridge of FIG. 2 typically includes a glass tubular member 12 which terminates in a mouth that is sealed by a rubber seal 14. The rubber seal 14 is pressed in sealing engagement with the mouth of the cartridge by means of a metal closure 16 that is swaged around the lip 18 of the cartridge.

In use, a cap (not shown) including a double-ended hypodermic needle is snaped onto the end of the cartridge shown in FIG. 2. Because of the position of the double-ended needle within the cap, one end of the double-ended needle punctures the rubber seal 14 and extends into the cartridge when the cap is snaped in place. The opposite end of the double-ended needle is used for making the injection.

Both the multiple dose vial of FIG. 1 and the hypodermic syringe cartridge of FIG. 2 may properly be considered to be containers for the fluid that they contain. Frequently, this fluid is a narcotic. Unauthorized persons have been known to insert a hypodermic syringe into such containers to aspirate the narcotic contents, and sometimes a second hypodermic syringe is used to replace the aspirated narcotic with water or a saline solution.

It is difficult to detect whether a multiple dose vial or a hypodermic syringe cartridge has been tampered with in this manner. The rubber seal used in both containers is relatively soft, and when the hypodermic syringe has been removed, it is very difficult to detect visually whether the rubber seal has been punctured.

It is this problem of pilferage of the contents of multiple dose vials and hypodermic syringe cartridges to which the present invention is addressed.

SUMMARY OF THE INVENTION

The various embodiments of the present invention constitute a family of devices which can be included in the mouth or neck of multiple dose vials or hypodermic syringe cartridges to provide a visual indication of whether the vial or cartridge has been tampered wiith. Typically, the devices include members which are disengaged from their normal position in the mouth or neck of the container by any penetrating object and which then fall into the container where they may be seen by virtue of their bright color and the magnifying effect of the container.

The novel features which are believed to be characteristic of the invention both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
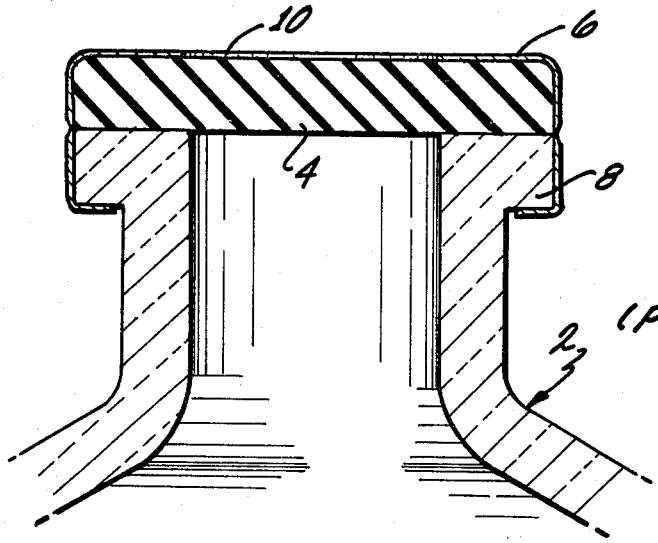
Fig. 1 (PRIOR ART)
FIG. 1 is a fractional cross-sectional view of a multiple dose vial of a type known in the prior art.
Figure 2:
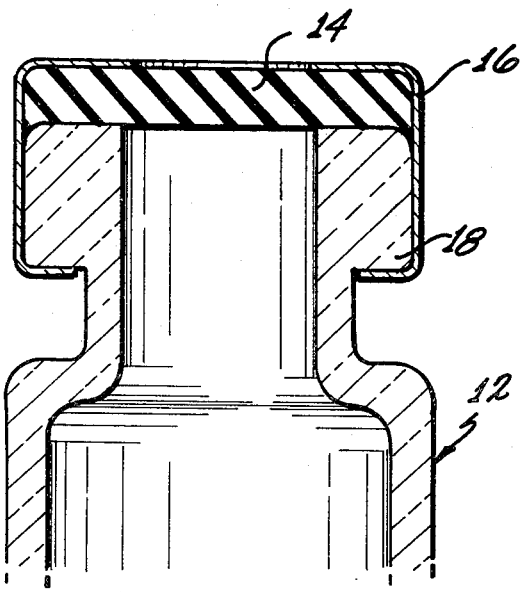
Fig. 2 (PRIOR ART)
FIG. 2 is a fractional cross-sectional view of a hypodermic syringe cartridge of the type known in the prior art.

Turning now to the drawings in which like reference numerals are used to denote the same parts throughout, it should be noted that although FIGS. 3–9 show various embodiments of the tamper-alerting device installed in a multiple dose vial, it is recognized that the tamper-alerting devices shown in FIGS. 3–9 can equally well be installed in hypodermic syringe cartridges of the type shown in FIG. 2.

Figure 3:
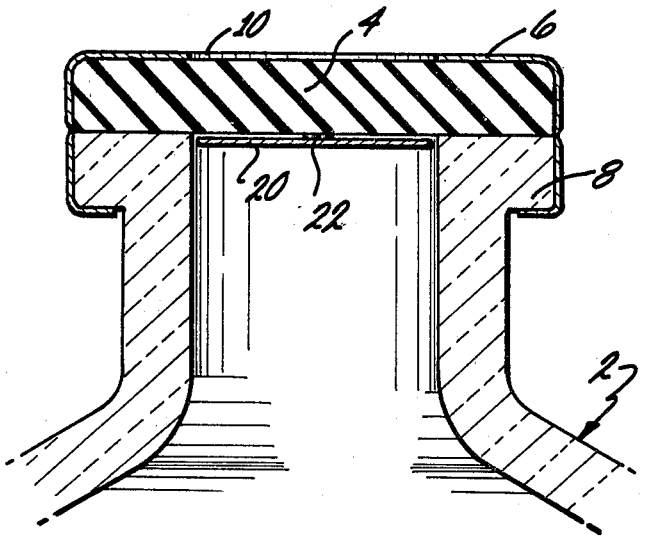
FIG. 3 is a fractional cross-sectional view of a first preferred embodiment of the tamper-alerting device of the present invention.

In the first preferred embodiment shown in FIG. 3, a disc 20 is bonded to the inwardly facing surface of the rubber seal 4 by a patch 22 of a suitable bonding material. In the preferred embodiment, the disc 20 is made of a visually conspicuous material or is coated with a visually conspicuous material or pattern, so as to impart to the disc a brightly-colored or highly reflective or striped appearance, for example. Also, in the preferred embodiment, the patch 22 is located in the central area of the disc 20. The patch 22 of bonding material produces a connection of limited strength between the disc 20 and the rubber seal. The connection is strong enough to prevent the disc from separating from the rubber seal under normal handling, but is broken by a force comparable to the force required to push a hypodermic needle through the seal.

In the preferred embodiment of FIG. 3, the disc 20 is impenetrable to a hypodermic needle, so that when a needle is pushed through the rubber seal 4, the tip of the needle will strike the disc 20, and if the needle is further advanced, the bond between the disc and the rubber seal will be broken, with the result that the disc 20 will be released into the space within the glass container 2.

Figure 4:
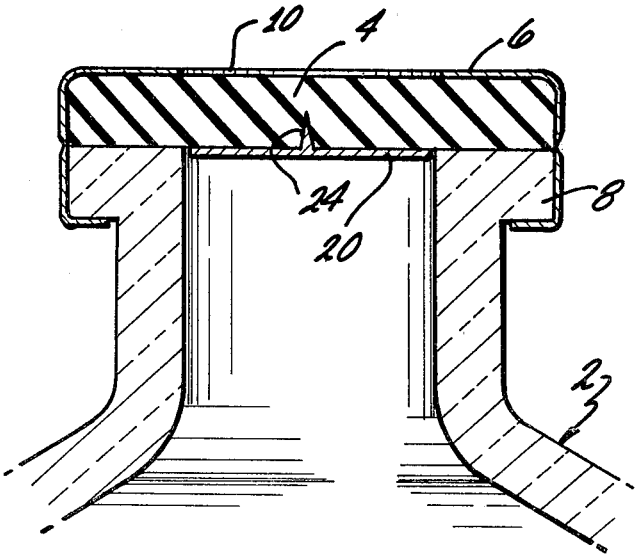
FIG. 4 is a fractional cross-sectional view of a second preferred embodiment of the tamper-alerting device of the present invention.

In the embodiment shown in FIG. 4, the disc 20 includes a tack or pin 24 which is stuck into the rubber seal 4 and which prevents the disc 20 from separating from the rubber seal 4 under normal handling shocks. However, when a hypodermic needle is inserted through the rubber seal 4, the tip of the needle bears against the disc 20 pulling the tack 24 free of the rubber seal 4 and permitting the disc 20 to fall freely into the glass container 2. As in the case of the embodiment of FIG. 3, in the embodiment of FIG. 4 it is desirable that the disc 20 be impenetrable by the hypodermic needle and that it present a conspicuous appearance.

Figure 5:
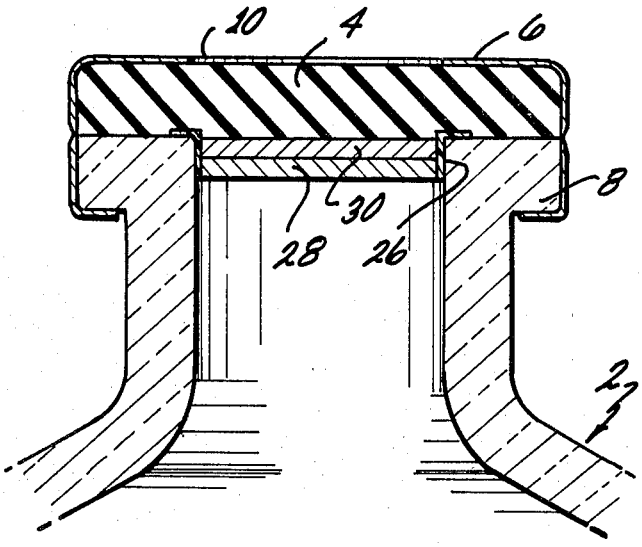
FIG. 5 is a fractional cross-sectional view of a third preferred embodiment of the tamper-alerting device of the present invention.

In the embodiment of FIG. 5, the device is supplied in the form of an insert consisting of a flanged member 26, an inner disc or plug 28 and an outer disc or plug 30. The insert is inserted into the mouth of the container 2 before the rubber seal 4 is applied. When a hypodermic needle is pushed against the outer disc 30, which is impenetrable to the needle, the outer disc 30 bears against the inner disc 28 pushing the inner disc into the container and free of the flanged member. This embodiment has the important advantage that the outer disc 30 continues to seal off the fluid contents of the glass container 2 from the intruding hypodermic needle until after the inner disc 28 has been freed. That is, if only a single disc were used, it might be possible, but highly unlikely, that the single disc could be tilted sufficiently that at some point on its circumference the fluid in the container might come in contact with the tip of the hypodermic needle, thereby defeating the purpose of the single disc device. However, when two discs or plugs are used in accordance with the present invention, it is found that the outer disc 30 maintains a seal until after the inner disc 28 has been freed.

In the embodiment of FIG. 5, it is necessary that the outer disc 30 be impenetrable to the point of a hypodermic needle, but it is not necessary that the inner disc 28 be impenetrable. It is desirable however that both discs 28, 30 present a conspicuous appearance. In the preferred embodiment of FIG. 5, the flanged member 26 is preferably molded of a plastic or rubber.

Figure 6:
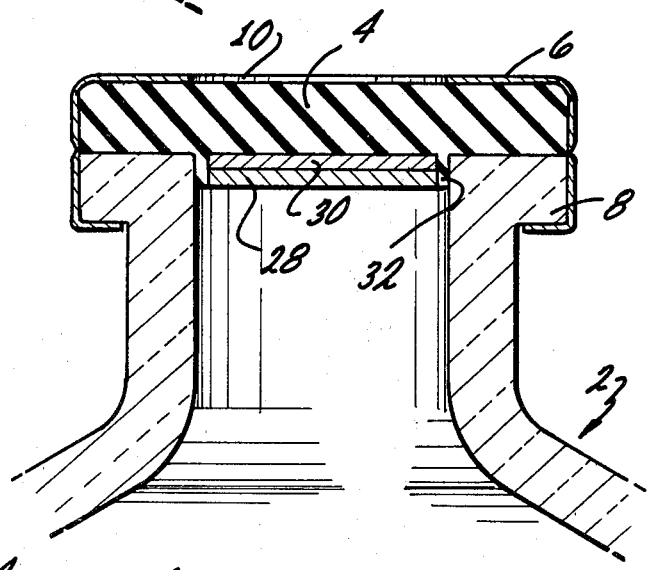
FIG. 6 is a fractional cross-sectional view of a fourth preferred embodiment of the tamper-alerting device of the present invention.

The embodiment of FIG. 6 is similar to that of FIG. 5 in its use of two discs, 28, 30; however, the manner in which the discs are mounted in the mouth of the bottle is different. In the embodiment of FIG. 6, the rubber seal 4 includes a raised circular ring or rim 32 into which the discs 28, 30 are inserted before the rubber seal 4 is applied to the container 2.

Figure 7:
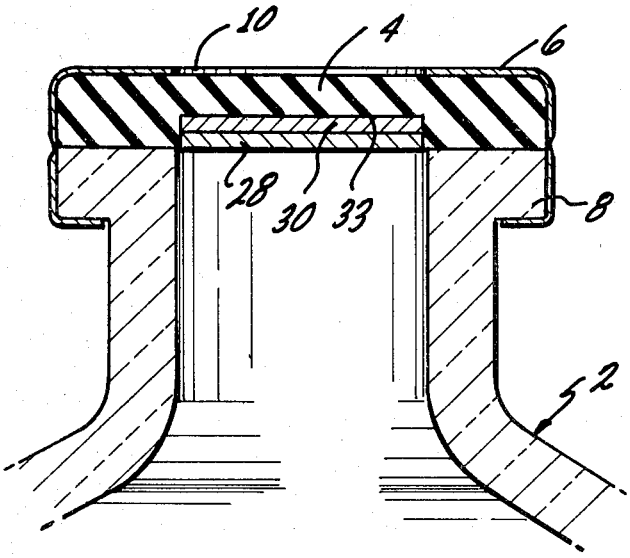
FIG. 7 is a fractional cross-sectional view of an alternative embodiment of the tamper-alerting device of the present invention.

In an alternative embodiment shown in FIG. 7, the discs 28, 30 are retained by friction at their edges within a recess 33 in the rubber seal 4.

Figure 8:
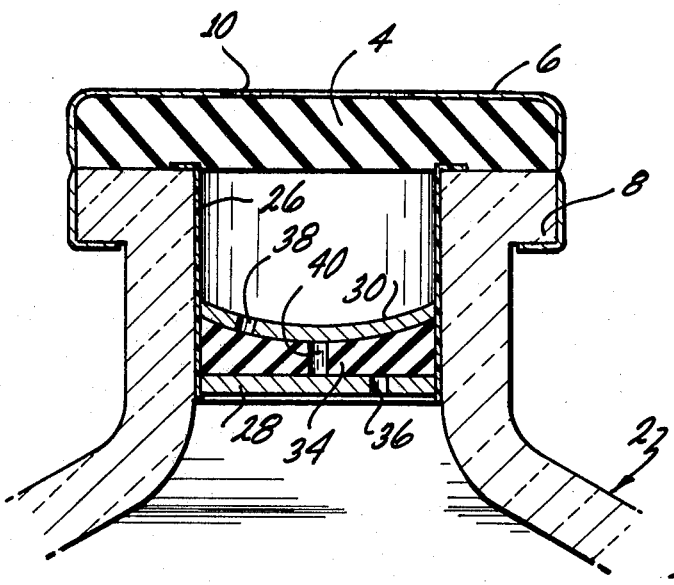
FIG. 8 is a fractional cross-sectional view of a fifth preferred embodiment of the tamper-alerting device of the present invention.

The embodiment of FIG. 8 is rather similar to the embodiment of FIG. 5 in that the device is supplied as an insert which includes a flanged member 26 that is inserted into the neck of the container 2. Likewise, the embodiment of FIG. 8 includes an inner disc 28 and an impenetrable outer disc 30.

The embodiment of FIG. 8 differs from the embodiment of FIG. 5 in two main respects. First, the inner disc 28 and the outer disc 30 are spaced apart by a resilient sealing member 34. The purpose of the resilient sealing member 34 is to prevent any of the fluid in the container 2 from access to an intruding hypodermic needle until after the inner disc 28 has been freed from the flanged member 26. In the preferred embodiment of FIG. 8, the resilient sealing member is made of a soft rubber.

The second way in which the embodiment of FIG. 8 differs from that of FIG. 5 is in the use of passages 36, 38, 40 in the inner disc 28, the outer disc 30 and the resilient sealing member 34 respectively. As shown in FIG. 8, these passages 36, 38, 40 are not aligned. As supplied, the inner disc 28 and the outer disc 30 are in close sealing contact with the resilient sealing member 34 so that the three parts 28, 34, 30 form a substantially leak-proof seal in the neck of the container 2 in spite of the passages 36, 38, 40.

The purpose of the passages 36, 38, 40 is to assure that the parts 28, 30, 34, once they have been freed from the flanged member 26 will not be able to block or clog the neck of the container.

Figure 9:
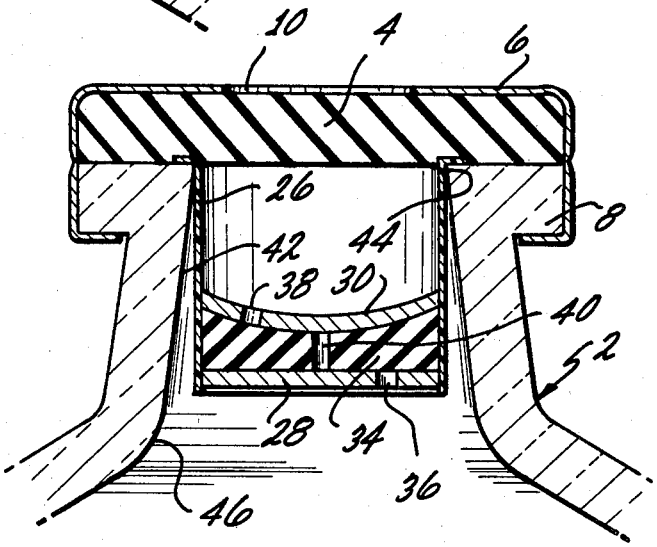
FIG. 9 is a fractional cross-sectional view of a sixth preferred embodiment of the tamper-alerting device of the present invention.

The embodiment shown in FIG. 9 is generally the same as that shown in FIG. 8, but FIG. 9 illustrates that the insert may be used in glass containers 2 that have necks 42 that are narrower at the mouth 44 than at the shoulder 46. In the embodiment of FIG. 9, it is desirable that the flanged member 26 be made of a material that is impenetrable to a hypodermic needle.

Figure 10:
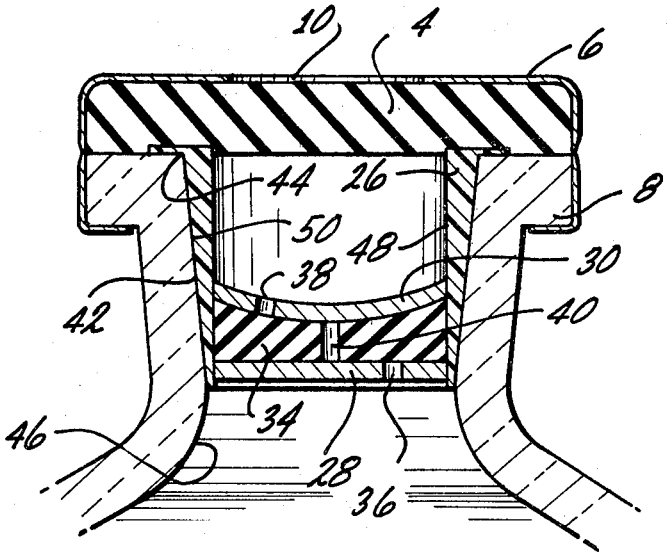
FIG. 10 is a fractional cross-sectional view of a seventh preferred embodiment of the tamper-alerting device of the present invention.

Likewise, the embodiment shown in FIG. 10 is similar to that of FIGS. 8 and 9. FIG. 10 shows how the flanged member 26 can be modified to permit the insert to be mounted in the neck of a particular kind of container 2, namely, a container in which the neck is smaller at the shoulder 46 than at the mouth 44. In this embodiment, the inside surface 48 of the flanged member 26 is substantially cylindrical, while the outside surface 50 of the flanged member 26 has a conical shape.

In another emmbodiment, the resilient sealing member 34 is bonded to the outer disc 30 so that those two parts form a unitary composite part.

Thus, there has been described a tamper-alerting device for use in multiple dose vials and hypodermic syringe cartridges. The device includes a visually conspicuous member which is retained in the neck of the container prior to withdrawal of any fluid from the container, but which is released into the container when an attempt is made to withdraw the contents of the container by inserting a hypodermic needle through the mouth of the container.

It is recognized that the member which is released into the container does not have to be disc-like in shape, although normally the member would include a cylindrical portion.

The foregoing detailed description illustrates several embodiments of the invention, and it is to be understood that additional embodiments thereof will be obvious to those skilled in the art. The embodiments described herein together with those additional embodiments are considered to be within the scope of the invention.

What is claimed is:

1. In a container of the type having a mouth sealed by a diaphragm that in normal use is penetrated by a hypodermic needle to permit the fluid contents of the container to be removed, the improvement comprising:

an insert mounted in the mouth of the container and defining a central opening; and, an object retained by a friction fit within the central opening of said insert in a position immediately adjacent the inwardly-facing surface of the diaphragm, so that said object will be dislodged from said insert by a hypodermic needle inserted through the diaphragm.

2. The improvement of claim 1 wherein the surface of said object includes a visually conspicuous material.

3. A tamper-alerting device for use with a container of the type having a mouth and a neck and that is sealed by a diaphragm-like seal that covers the mouth of the container, through which seal a user normally inserts a hypodermic needle to remove a fluid from the container, said tamper-alerting device comprising:

an insert of such size and shape as to fit into the neck of a container and to engage said container in a substantially watertight seal, said insert including a hollow open-ended cylindrical portion;

an inner plug fitting snugly in said cylindrical portion, retained therein by friction, and located at the innermost end of said cylindrical portion; and, an outer plug fitting snugly in said cylindrical portion, retained therein by friction, engaging said cylindrical portion in a substantially watertight seal, and located between said inner plug and the seal, said outer plug impenetrable by a hypodermic needle;

whereby, when said insert containing said inner plug and said outer plug has been fitted into the neck of the container, a hypodermic needle inserted into the neck of the container cannot come in contact with the fluid in the container until the inner plug has been pushed out of said insert and freed to migrate into the container.

4. The tamper-alerting device of claim 3 further comprising a sealing plug fitting snugly in said cylindrical portion between said inner plug and said outer plug, engaging said cylindrical portion, said inner plug and said outer plug in a substantially watertight seal, and wherein said inner plug, said sealing plug, and said outer plug each include longitudinal passages that do not communicate.

5. The tamper-alerting device of claim 3 wherein the surface of said inner plug includes a visually conspicuous material.

6. A tamper-alerting device for insertion into the neck of a container of the type having a closure which includes a diaphragm that in normal use is punctured by a hypodermic needle to permit the contents of the container to be removed, said tamper alerting device comprising:

an insert located in the neck of the container, coaxial with the neck, having an inner end nearer the body of the container and having an outer end nearer the mouth of the container;

an alerting member retained by the inner end of said insert in a friction fit;

a sealing member retained in slidable sealing engagement within said insert intermediate said alerting member and the outer end of said insert, said sealing member including a portion that is impenetrable by a hypodermic needle, whereby the contents of the container can be removed only by forcing said sealing member inwardly beyond the inner end of said insert, which necessarily results in said alerting member being pushed beyond the inner end of said insert and thereby freed.

7. The tamper-alerting device of claim 6 wherein the surface of said inner plug includes a visually conspicuous material.

* * * * *